US011326769B2

(12) United States Patent
Majerczyk

(10) Patent No.: US 11,326,769 B2
(45) Date of Patent: May 10, 2022

(54) METHOD AND APPARATUS FOR BEZEL ATTACHMENT

(71) Applicant: JST Performance, LLC, Gilbert, AZ (US)

(72) Inventor: Jacob R. Majerczyk, Scottsdale, AZ (US)

(73) Assignee: JST Performance, LLC, Gilbert, AZ (US)

( * ) Notice: Subject to any disclaimer, the term of this patent is extended or adjusted under 35 U.S.C. 154(b) by 280 days.

(21) Appl. No.: 15/691,491

(22) Filed: Aug. 30, 2017

(65) Prior Publication Data

US 2018/0058679 A1 Mar. 1, 2018

Related U.S. Application Data

(60) Provisional application No. 62/382,069, filed on Aug. 31, 2016.

(51) Int. Cl.

| | |
|---|---|
| ***F21V 31/00*** | (2006.01) |
| ***F21V 17/12*** | (2006.01) |
| ***F21V 29/74*** | (2015.01) |
| ***F21V 3/00*** | (2015.01) |
| *F21V 15/01* | (2006.01) |
| *F21V 29/75* | (2015.01) |
| *F21V 29/76* | (2015.01) |

(52) U.S. Cl.

CPC ..... *F21V 31/005* (2013.01); *F21V 3/00* (2013.01); *F21V 17/12* (2013.01); *F21V 29/74* (2015.01); *F21V 15/01* (2013.01); *F21V 29/75* (2015.01); *F21V 29/76* (2015.01)

(58) Field of Classification Search

CPC ..... F21V 31/005; F21V 3/00; F21V 29/74; F21V 17/12

See application file for complete search history.

(56) References Cited

U.S. PATENT DOCUMENTS

| | | | | |
|---|---|---|---|---|
| 4,299,008 A * | 11/1981 | Burns | ..... | A47H 1/06 16/95 D |
| 2004/0187426 A1* | 9/2004 | Callahan | ..... | E04C 3/08 52/648.1 |
| 2012/0087118 A1* | 4/2012 | Bailey | ..... | F21V 5/04 362/235 |

* cited by examiner

*Primary Examiner* — Laura A Gudorf
(74) *Attorney, Agent, or Firm* — Calfee, Halter & Griswold LLP

(57) ABSTRACT

A rail nut spacer is shown and described, and may have a body and one or more threaded inserts positioned along a width of the body. Threaded inserts may be retained within the rail nut spacer by surface characteristics on each insert to prevent movement thereof with respect to the rail nut spacer. The rail nut spacer may be inserted in a first direction into a slot extending through a width of a housing, such that the slot prevents movement of the rail nut spacer in a second direction. Fasteners may extend through a bezel, through the slot, and/or through the threaded inserts to secure the bezel to the rail nut spacer. The bezel may exert a force on a media to secure the media to the housing. The bezel, media, and/or housing may be sealed together by a gasket to protect an interior of the housing from contaminants.

20 Claims, 8 Drawing Sheets

METHOD AND APPARATUS FOR BEZEL ATTACHMENT

FIELD OF THE INVENTION

The present invention generally relates to attachment systems, and more particularly to bezel attachment systems integrated with lighting fixtures.

BACKGROUND

Light emitting diodes (LEDs) have been utilized since about the 1960s. However, for the first few decades of use, the relatively low light output and narrow range of colored illumination limited the LED utilization role to specialized applications (e.g., indicator lamps). As light output improved, LED utilization within other lighting systems, such as within LED "EXIT" signs and LED traffic signals, began to increase. Over the last several years, the white light output capacity of LEDs has more than tripled, thereby allowing the LED to become the lighting solution of choice for a wide range of lighting solutions.

LEDs may be used in a broad spectrum of environments, both adverse and non-adverse. Depending on the application, the LEDs and associated control circuitry, such as a printed circuit board (PCB), may need to be sealed from the environment.

In general, LEDs and associated control circuitry are contained in a compartment with a covering across at least a portion of the compartment. Conventional coverings may be adhered to the compartment; however, adhesive generally prevents removal of the covering without causing damage to the covering and/or the compartment. Conventional coverings may be attached by threading fasteners into a narrow slot; however, slots may be stripped from over-tightening or repeated loosening and tightening of the fasteners. Conventional fasteners may be attached by threading fasteners into a series of threaded apertures; however, drilling and tapping threaded apertures into a compartment may cause a substantial increase in cost and time of manufacturing. Conventional fasteners may be attached by threading fasteners into a series of threaded receivers (e.g., square nuts, T-slot nuts, etc.); however, the spacing of the receivers may become increasingly difficult over long spans, which may cause a substantial increase in cost and time of manufacturing.

For example, fasteners may secure a bezel along at least a portion of a perimeter of the covering, thereby securing the covering. Where fasteners extend into one or both of a threaded hole and/or an interference slot, the holes/slots may be stripped as described above. In another example, where fasteners extend into threaded receivers aligned by spacers in a nut-receiving channel, the use of a plurality of square nuts and spacers significantly increases the manufacturing cost and assembly time to affect sealing of the covering to the compartment.

Efforts continue, therefore, to develop bezel attachment systems which enable sealing of the LEDs and associated control circuitry from adverse environments while reducing manufacturing cost and assembly time.

SUMMARY

To overcome limitations in the prior art, and to overcome other limitations that will become apparent upon reading and understanding the present specification, various embodiments of the present invention disclose a method and apparatus for securing a bezel to a rail nut spacer contained in a slot extending across a housing.

In accordance with one embodiment of the invention a rail nut spacer, coupled within a slot of a lighting fixture, may include a body having a width, and one or more threaded inserts coupled with substantially equal spacing along the width of the body, wherein the one or more threaded inserts are restricted from movement relative to the body.

In another embodiment of the invention, a rail nut spacer, coupled within a slot of a housing, may include a body having a width and a parallelogram cross-section which restricts movement of the rail nut spacer within the slot, and one or more threaded inserts coupled along the width of the body, wherein the one or more threaded inserts are restricted from movement relative to the body.

In another embodiment of the invention, a bezel attachment system includes a housing having a compartment extending a width of the housing, a slot extending along the width of the housing, a first rail nut spacer configured in the slot, a media configured in a covering relationship with the compartment, a bezel configured in a covering relationship with the slot, and a plurality of fasteners coupled to the first rail nut spacer through the slot, and the plurality of fasteners coupled to the bezel, such that the bezel is coupled to the housing.

BRIEF DESCRIPTION OF THE DRAWINGS

Various aspects and advantages of the invention will become apparent upon review of the following detailed description and upon reference to the drawings in which.

DETAILED DESCRIPTION

Figure 1:
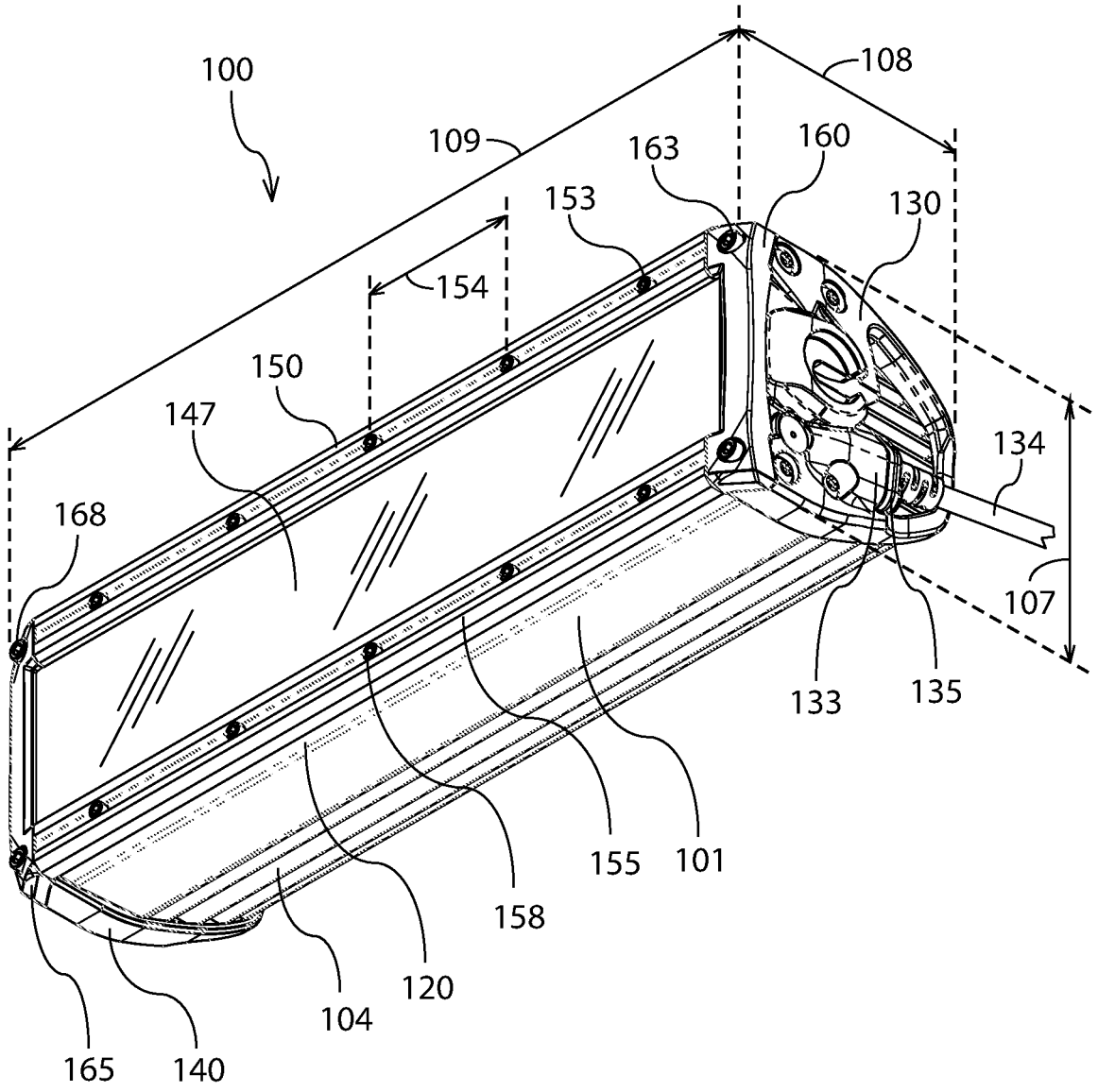
FIG. 1 illustrates an isometric view of a lighting fixture having bezels mounted on a front face thereof for securing a transparent media.

Generally, the various embodiments of the present invention are applied to an apparatus for securing a covering (e.g. a media) to enclose and/or seal a compartment (e.g., an opening) of a lighting fixture. The sealing may isolate an interior environment of the compartment from an exterior environment. Any discussion of a seal, sealing, or the sealed nature of component parts may refer to all of an air-tight seal, a water-tight seal, and any other seal designed to prevent passage of particulates (e.g., moisture) or other contaminants therethrough.

According to the present invention, a rail nut spacer may be assembled in a slot within a housing of the lighting fixture. Further, the rail nut spacer may include a body portion having a particular cross-sectional shape which may be a negative of a corresponding cross-sectional shape of the slot, such that when assembled, the rail nut spacer is discouraged from movement by the slot in at least one direction. The rail nut spacer may have an internal dimension that is greater than the slot, such that the rail nut spacer may be prevented from being removed through the slot (e.g., the rail nut spacer may be inserted from a side of the slot or a side of the housing, but the slot may prevent the rail nut spacer from being moved in a direction that is perpendicular to the direction in which the rail nut spacer is inserted into the slot).

The rail nut spacer may have one or more apertures spaced along a width of the body portion for receiving one or more inserts therein. Each insert may be visible through the slot of the housing when the rail nut spacer is assembled within the housing. The inserts may each have a threaded aperture to enable a fastener (e.g., a screw) to be secured to each insert through the slot of the housing.

A bezel may be situated in a covering relationship across the slot of the housing and/or across the rail nut spacer. The bezel may have one or more apertures spaced along a width of the bezel, which may be substantially aligned with the threaded apertures of each insert. One or more fasteners may be inserted through each aperture of the bezel, may pass through the slot of the housing, and may extend into each insert of the rail nut spacer. Tightening of the fasteners may cause the bezel to be tightened against the housing.

A media may be placed over an opening in the housing, such that the media substantially covers the opening. The media may be transparent, translucent, and/or opaque. Further, the media may have discrete zones of transparency, translucence, and/or opaqueness. The media may be homogenous across its width, height, and depth. The bezel may extend at least partially across the media on a forward surface, and the housing may extend at least partially across the media on an opposing surface, such that when the bezel is tightened against the housing the media is held therebetween (e.g., pinched between the bezel and the housing).

A gasket may extend across the media to facilitate a sealing of the opening. Further, the gasket may be deformed when the bezel is tightened. For example, the gasket may be compressed between the any one or more of the media, the bezel, and the housing.

The rail nut spacer may have one or more grooves extending through a discrete portion of a body portion. The grooves may enable the rail nut spacer to be singulated into two or more segments. For example, the rail nut spacer may be split into two rail nut spacer segments by singulation at a single groove. In another example, the rail nut spacer may be split into three or more rail nut spacer segments by singulation at two or more grooves. One or more rail nut spacers and one or more segments may be assembled within a slot of a lighting fixture of any length.

While the above discussion has been with reference to a single bezel and a single slot, a person of ordinary skill in the art will appreciate that additional rail nut spacers, segments, bezels and slots may be implemented.

FIG. 1 illustrates a lighting fixture 100 including the bezel attachment system of the present invention. Lighting fixture 100 may include a housing 101 for attachment of the various other components of the system. Housing 101 may have a height 107 (e.g., extending between upper and lower faces), a depth 108 (e.g., extending between forward and rearward faces), and a width 109 (e.g., extending between rightward and leftward faces). Further, the housing may have one or more heat sinking fins (e.g., fins 104) extending therefrom to facilitate cooling of lighting fixture 100. For example, fins 104 may extend rearwardly of housing 101 (e.g., toward the rearward face).

Housing 101 may have a compartment (e.g., opening 405 of FIG. 4) extending from the forward face toward the rearward face along a portion of depth 108 to house the electrical components of the system, for example, a printed circuit board assembly (PCBA), light emitting diodes (LEDs), reflectors, and/or lenses. The compartment may be formed by one or more perimeter walls (e.g., bottom perimeter wall 120) of housing 101, one or more end caps (e.g., right and left end caps 130, 140), a body portion (e.g., body portion 402 of FIG. 4), or any combination thereof. For example, perimeter walls may span upper and lower faces of the compartment and may extend the width 109 of housing 101. In another example, end caps may span right and leftward faces of the compartment and may extend the height 107 of housing 101. In another example, a body portion may span a rearward face of the compartment and may extend the width 109 and height 107 of housing 101.

The compartment (e.g., opening 405 of FIG. 4) may be enclosed and/or sealed by a covering (e.g., media 147) to protect the electrical components of the system from moisture and/or other contaminants. Media 147 may extend substantially across height 107 and across width 109. For example, media 147 may extend from the bottom perimeter wall 120 to a top perimeter wall (e.g., from top perimeter wall 410 to bottom perimeter wall 420 of FIG. 4). In another example, media 147 may extend from the right end cap 130 to the left end cap 140.

At least one end cap (e.g., right end cap 130) may have an egress 133 to enable the passage of a cable 134 to the interior of the compartment. Cable 134 may provide power and/or data signals to the electrical components of the system to enable the production of light. Cable 134 may be sealed within egress 133 (e.g., via a gasket 135), to protect the electrical components of the system from moisture and/or other contaminants.

One or more bezels (e.g., bezels 150, 155, 160, 165) may enable securement of media 147 across the compartment. For example, at least two bezels (e.g., bezels 150, 155) may extend width 109 of housing 101. In another example, at least two bezels (e.g., bezels 160, 165) may extend height 107 of housing 101. One or more bezels may be secured to housing 101 (e.g., to perimeter walls), and/or one or more bezels may be secured to end caps (e.g., end caps 130, 140). For example, top bezel 150 may be secured to a top perimeter wall (e.g., top perimeter wall 410 of FIG. 4). In another example, bottom bezel 155 may be secured to the bottom perimeter wall 120 of housing 101. In another example, right bezel 160 may be secured to the right end cap 130. In another example, left bezel 165 may be secured to the left end cap 140. The one or more bezels may extend around a perimeter of media 147 corresponding to a perimeter formed by the perimeter walls and/or the end caps. Further, the perimeter of media 147 may substantially correspond to a perimeter of the compartment (e.g., opening 405 of FIG. 4). In another example, a single bezel may extend around a perimeter of media 147.

Figure 2:
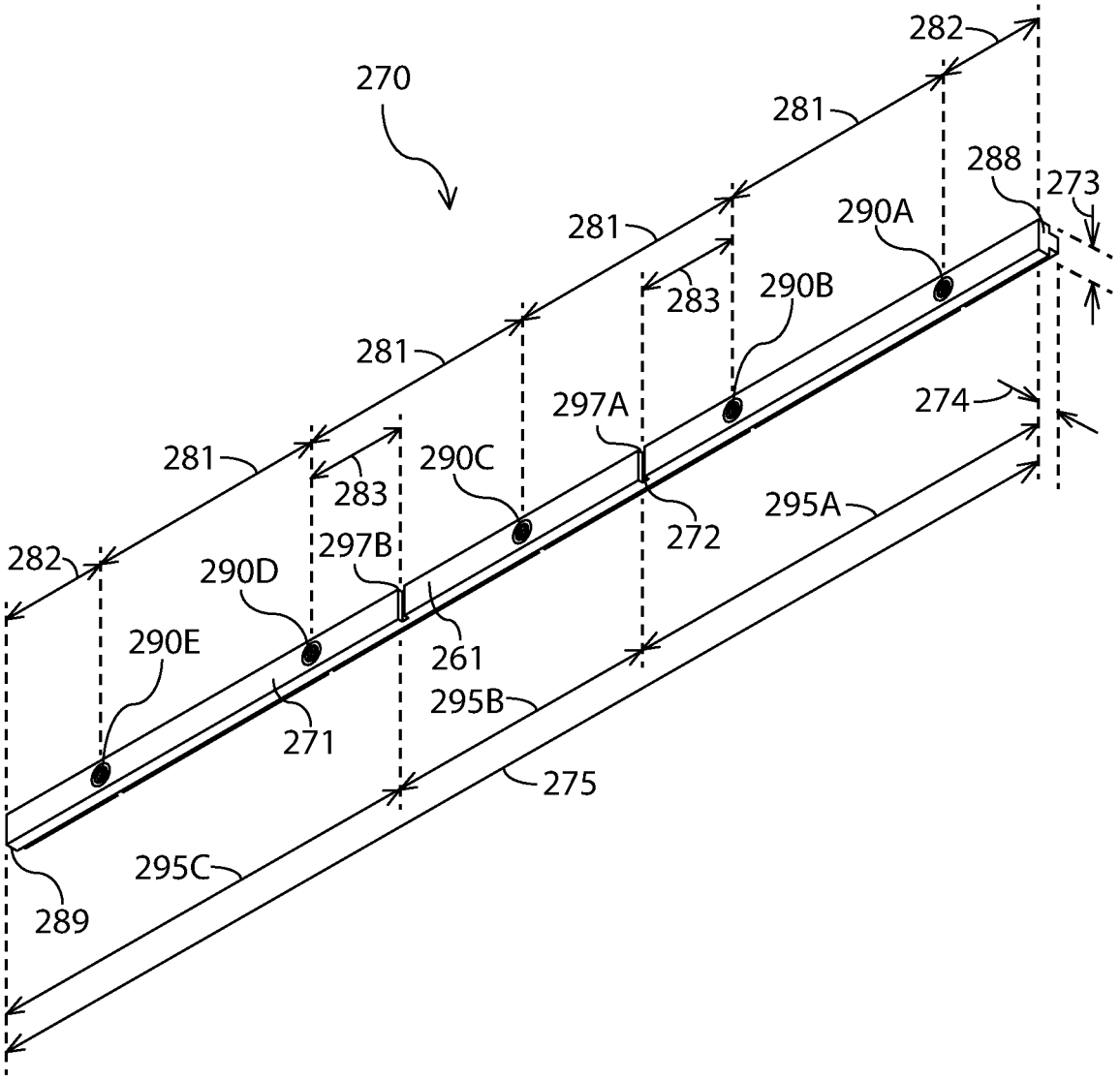
FIG. 2 illustrates an isometric view of a rail nut spacer, according to an embodiment of the present invention.

One or more of bezels 150, 155, 160, 165 may be secured to perimeter walls and/or end caps by one or more rail nut spacers (e.g., rail nut spacer 270 of FIG. 2). The bezels may be secured by one or more fasteners (e.g., fasteners 153, 158, 163, 168) extending through each bezel and into a respective rail nut spacer (e.g., as exemplified in FIG. 6). For example, a first set of fasteners 153 may extend through bezel 150 into a rail nut spacer. In another example, a second set of fasteners 158 may extend through bezel 155 into a rail nut spacer. In another example, a third set of fasteners 163 may extend through bezel 160 into a rail nut spacer. In another example, a fourth set of fasteners 168 may extend through bezel 165 into a rail nut spacer.

Each set of fasteners 153, 158, 163, 168 may have the same length, thread pitch, and head size. Alternatively, lengths, pitches, and sizing may be different for one or more of the pluralities of fasteners. For example, fasteners 153, 158 may have a first length, a first pitch, and a first head size and fasteners 163, 168 may have a second length, a second pitch, and a second head size.

Each fastener in each set of fasteners may be spaced a distance 154 to enable adequate securement of a corresponding bezel (e.g., bezel 150) to housing 101, end caps 130, 140, or any combination thereof. For example, distance 154 may be between about 0.25 inches and about 5 inches (e.g., about 2 inches). Spacing may be optimized to ensure that adequate and/or sufficient pressure is applied to seal media 147 over the compartment.

FIG. 2 illustrates an isometric view of a rail nut spacer 270, according to an embodiment of the present invention. Rail nut spacer 270 may have a height 273 and a depth 274, each sized for interconnection with a slot in a housing of a lighting fixture (e.g., slot 511 of FIG. 5). Height 273 may be between about 0.125 inches and about 0.5 inches (e.g., about 0.25 inches). Depth 274 may be between about 0.125 inches and about 0.5 inches (e.g., about 0.1875 inches). Nevertheless, a person of ordinary skill in the art will appreciate that the rail nut spacer may be scalable to sizes outside the ranges herein disclosed. Furthermore, rail nut spacer 270 may have a non-uniform cross-section in a height-depth plane, such as a "T" shaped cross-section (e.g., as exemplified in FIG. 3).

Figure 6:
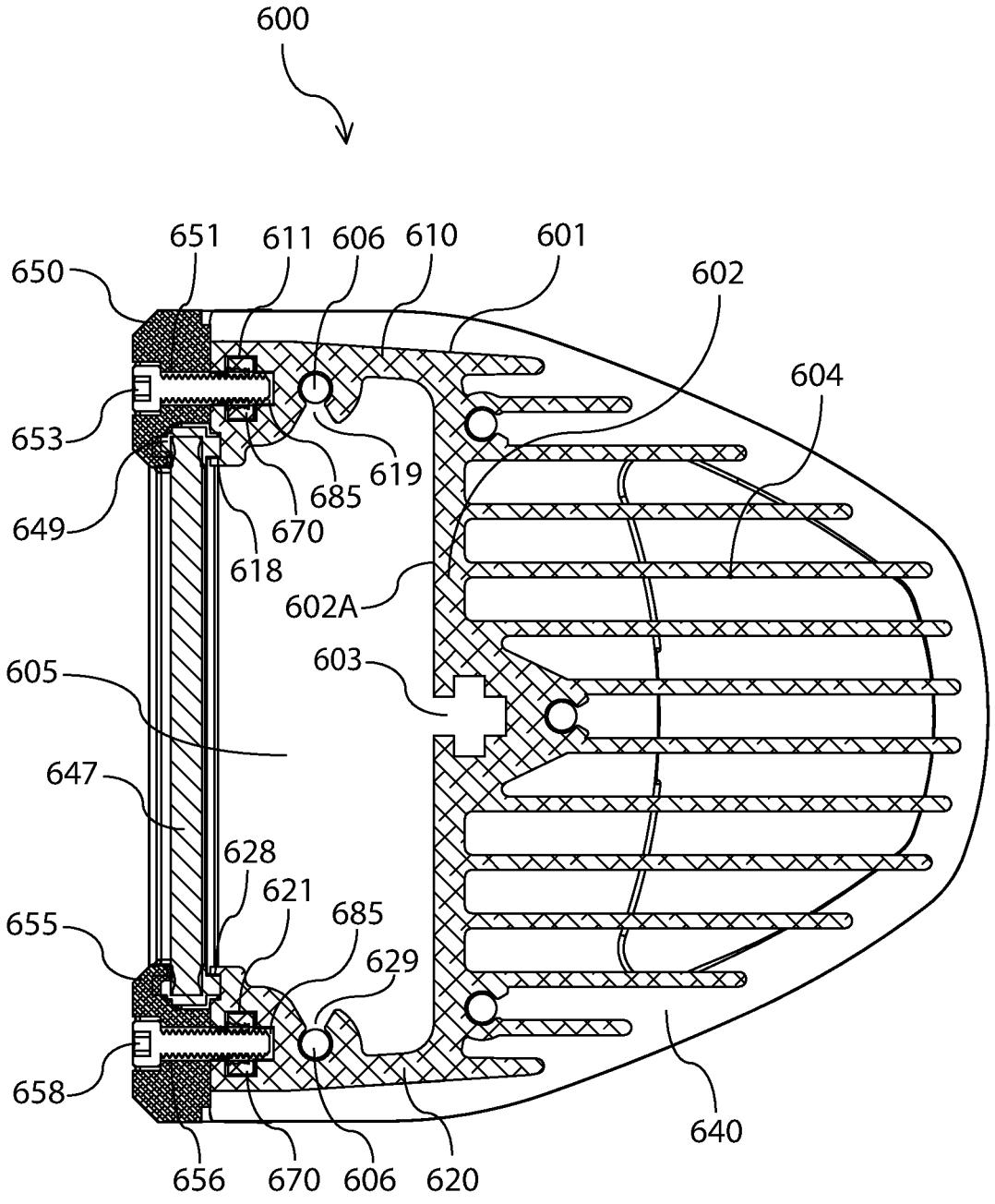
FIG. 6 illustrates a cross-sectional view of the lighting fixture of FIG. 1.

Rail nut spacer 270 may have a width 275 sized for interconnection with the slot in the housing (e.g., slot 611 of FIG. 6). Width 275 may be between about 2 inches and about 60 inches (e.g., about 9.8125 inches). Nevertheless, a person of ordinary skill in the art will appreciate that the rail nut spacer may be scalable to sizes outside the ranges herein disclosed. For example, width 275 may substantially correspond to a width of the housing (e.g., width 109 of housing 101 of FIG. 1). In another example, width 275 may substantially correspond to a distance half the width of a lighting fixture (e.g., two rail nut spacers may collectively span a width of lighting fixture 700D in FIG. 7). Similarly, width 275 may extend a distance ⅓, ¼, ⅕, or less of the width of a lighting fixture (e.g., a lighting fixture having a width that is 3, 4, 5, or more times width 275).

Rail nut spacer 270 may include a body portion 271 with one or more inserts (e.g., inserts 290A-290E) interposed along width 275 to enable securement of fasteners (e.g., fasteners 153 of FIG. 1). For example, at least one insert may be interposed in rail nut spacer 270. In another example, two or more inserts may be interposed in rail nut spacer 270. In another example, five inserts, including inserts 290A-290E may be interposed in rail nut spacer 270. Body portion 271 may ensure proper spacing of inserts 270.

Inserts 290 may be formed integrally with body portion 271 during manufacture. Alternatively, inserts 290 may be formed separately and integrated with body 271 during manufacture of body 271. Alternatively, inserts 290 may be formed separately and integrated with body 271 after manufacture of body 271. Inserts 290 and body 271 may be formed of any suitable material. For example, inserts 290 and body 271 may be formed of metal (e.g., aluminum), plastic (e.g., Lexan resin), and/or composite material (e.g., glass-filled nylon). Furthermore, the material used for body 271 may be the same as or different from the material used for inserts 290.

Inserts 290 may be spaced along a span of height 273 (e.g., at a midpoint), and may be spaced along a span of width 275 (e.g., incrementally along width 275), though additional configurations may be possible. For example, each insert 290 may be spaced similar or different distances from each adjacent insert. In another example, each insert 290 may be spaced a distance 281 from each adjacent insert to enable attachment to a bezel (e.g., where distance 281 corresponds to distance 154 of bezel 150 of FIG. 1). In another example, distance 281 may be between about 0.25 inches and about 5 inches (e.g., about 2 inches). For example, body 261 may ensure inserts 270 are aligned with fasteners extending through the bezel (e.g., fasteners 153 extending through bezel 150).

The right- and left-most inserts (e.g., inserts 290A, 290E) may be spaced from right and left faces 288, 289 of rail nut spacer 270, respectively, to ensure proper spacing with respect to one or more fasteners and/or one or more bezels. For example, the right-most insert (e.g., insert 290A) may be a first distance from the right face 288 of rail nut spacer 270, and the left-most insert (e.g., insert 290E) may be a second distance from the left face 289 of rail nut spacer 270. The first distance may the same as or different than the second distance. In another example, right-most insert 290A and left-most insert 290E may each be a distance 282 from right and left faces 288, 289 of rail nut spacer 270, respectively. In another example, distance 282 may be between about 0.125 inches and about 3 inches (e.g., about 1 inch). Thus, body 271 of rail nut spacer 270 may enable inserts 290 to be spaced in any relation as desired, and may fix the positions of each insert 290 along width 275 and height 273. Distances 282 may be the same as, greater than, or less than distances 281.

Rail nut spacer 270 may have one or more grooves (e.g., grooves 297A, 297B) spaced along width 275 to enable rail nut spacer 270 to be singulated into two or more segments (e.g., segments 295A-295C). For example, a single groove may enable singulation into two segments. In another example, grooves 297A, 297B may enable singulation into two or three segments. In another example, a rail nut spacer 270 having N grooves may be singulated into a number of segments T in accordance with equation (1) as:

$$T=N+1 \tag{1}$$

In another example, groove 297A may enable rail nut spacer 270 to be singulated into a first segment (e.g., segment 295A) and a second segment (e.g., segments 295B, 295C, collectively). In this example, the second segment may further be singulated into a third segment (e.g., segment 295B) and a fourth segment (e.g., segment 295C). Each of the above segments (e.g., segments 295A-295C) may be used alone and/or in combination with another segment in a lighting fixture. Further, each segment may be used alone and/or collectively with a non-singulated rail nut spacer.

Grooves 297A, 297B may extend through a discrete portion of body 271 (e.g., extending a height and/or a depth) to ensure breakage of rail nut spacer 270 at the desired position along width 275. For example, groove 297A may extend a depth less than depth 274. In another example, groove 297A may extend between about ⅛ and about ⅞ of depth 274 (e.g., about ¼ of depth 274 from a forward face of rail nut spacer 270). In another example, groove 297A may extend a height as great as height 273. In another example, groove 297A may extend between about ⅛ of height 273 and height 273 (e.g., about height 273). In another example, groove 297B may be dimensioned the same as, similarly to, or differently from groove 297A.

Each groove (e.g., grooves 297A, 297B) may be spaced a distance from a corresponding insert 290 to enable adequate spacing of inserts in a rail nut spacer segment. For example, a groove may be spaced a first distance leftward of an insert (e.g., between about 0.125 inches and about 3 inches). In another example, a groove may be spaced a second distance rightward of an insert (e.g., between about 0.125 inches and about 3 inches). The first distance may be the same as or different than the second distance. In another example, groove 297A may be spaced a distance 283 from insert 290B (e.g., about 1 inch) and between insert 290B and left face 289. In another example, groove 297B may be spaced a distance 283 from insert 290D (e.g., about 1 inch) and between insert 290D and right face 288. Distance 283 may be the same as or different from distance 282 and/or distance 281.

Grooves (e.g., grooves 297A, 297B) and inserts (e.g., inserts 290A-290E) may be arranged in any order along width 275. For example, the grooves and inserts may be arranged symmetrically (e.g., as exemplified in FIG. 2) or non-symmetrically. Further, the number of inserts between and/or on either side of each groove may be the same or different. Insert 270 is illustrated with one insert (e.g., insert 290C) between each groove (e.g., grooves 297A, 297B), two inserts (e.g., inserts 290A, 290B) on a right side, and two inserts (e.g., inserts 290D, 290E) on a left side of the grooves. Alternatively, two or more inserts may be located between each groove. Alternatively, two or more grooves may be located between each insert. Alternatively, one or more inserts may be located between a groove and the end of the rail nut spacer (e.g., 3 inserts). A person of ordinary skill in the art will appreciate that additional configurations are possible to enable adequate spacing of inserts and grooves in each rail nut spacer 270.

While rail nut spacer 270 may be illustrated with two grooves (e.g., grooves 297A, 297B) and five inserts (e.g., inserts 290A-290E), a person of ordinary skill in the art will appreciate that more or less grooves and inserts may be included to enable adequate spacing of inserts and attachment to a bezel. Furthermore, a person of ordinary skill in the art will appreciate that rail nut spacer 270 may be scalable, such that height 273, depth 274, and width 275, and distances 281, 282, and 283 may be increased or decreased to values beyond the example ranges listed, and therefor may accommodate lighting fixtures of various heights, depths and widths.

Figure 3A:
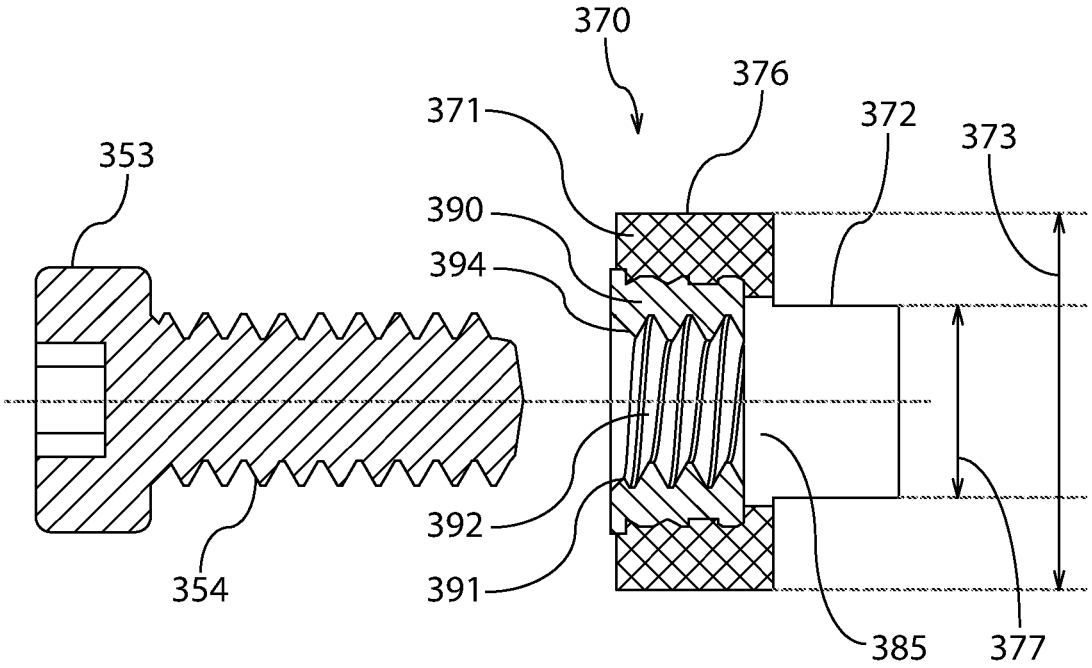
FIG. 3A illustrates a cross-sectional view of the rail nut spacer of FIG. 2 before having a fastener engaged therewith.
Figure 3B:
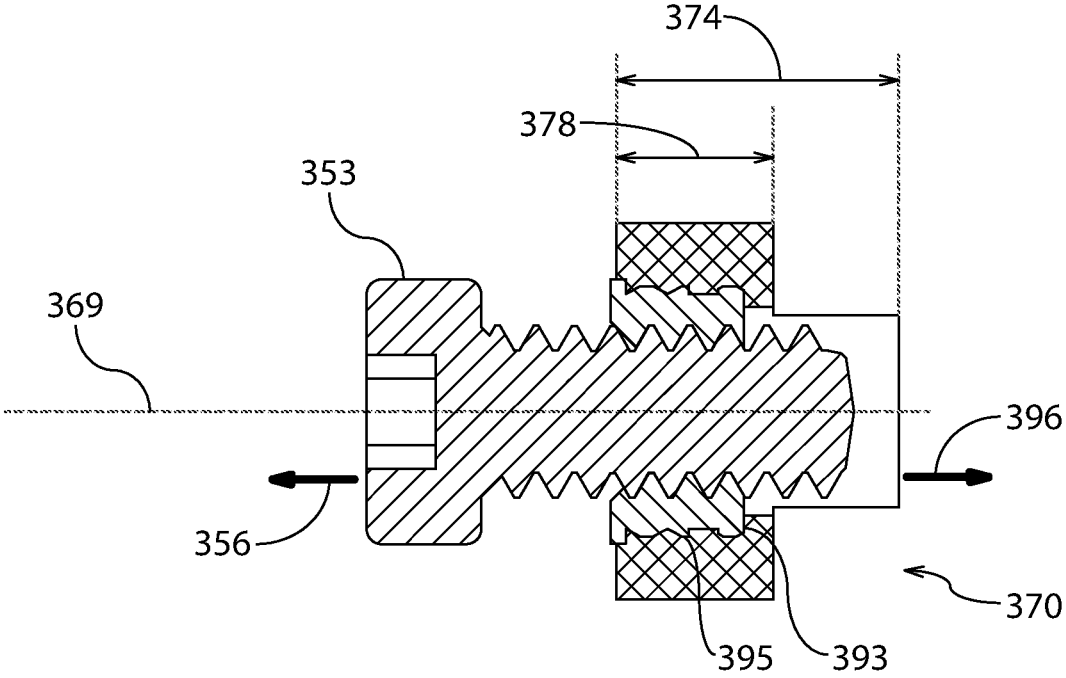
FIG. 3B illustrates a cross-sectional view of the rail nut spacer of FIG. 2 having a fastener engaged therewith.

FIGS. 3A and 3B illustrate a cross-sectional cut view through a rail nut spacer 370, according to an embodiment of the present invention. The cross-sectional cut may extend through a height-depth plane of the rail nut spacer 370 (e.g., height 373 and depth 374). Rail nut spacer 370 may have a body portion 371 with a particular cross-sectional shape corresponding to a cross-sectional shape of a slot of a lighting fixture (e.g., slot 611 of lighting fixture 600, of FIG. 6). The particular cross-sectional shape of body 371 may discourage rotational and/or translational movement of rail nut spacer 370 when assembled within the lighting fixture (e.g., as rail nut spacer 870 is assembled within housing 801 in FIG. 8).

For example, body portion 371 may substantially be a negative image of the slot (e.g., slot 611 of FIG. 6). In another example, body portion 371 may substantially appear as any one or more of a "+" shape, a "C" shape, a "T" shape (as exemplified in FIGS. 3A and 3B), a "V" shape, an "L" shape, a "U" shape, and/or any other parallelogram shape (e.g., a triangular shape), such that rotational and/or translational movement of rail nut spacer 370 within the slot is discouraged.

In another example, body portion 371 may include one or more central portions 372 extending a central height 377 and spanning depth 374, and may further include one or more extending portions 376 extending height 373 and spanning an intermediate depth 378. In one example, central height 377 may be less than height 373, and intermediate depth 378 may be less than depth 374. In another example, extending portion 376 may extend one or both of above and below central portion 372, such that height 373 may extend one or both of above and below central height 377 (e.g., extending above and below as exemplified in FIG. 3A). In another example, central portion 372 may extend one or both of leftward and rightward of extending portion 376, such that depth 374 may extend one or both of leftward and rightward of intermediate depth 378 (e.g., extending rightward only as exemplified in FIG. 3A).

Body 371 may have at least one aperture 385 extending therethrough for receiving at least one insert 390. For example, aperture 385 may extend through body 371 along central axis 369. In another example, axis 369 may represent a symmetrical plane of the cross-section through rail nut spacer 370. Aperture 385 may span a height extending perpendicularly through axis 369 toward the exterior of body 371. For example, aperture 385 may extend a height of between about ⅕ and about ⅘ of height 373 (e.g., about 6/11 of height 373). In another example, aperture 385 may extend a height of between about 0.05 inches and about 0.4 inches (e.g., about 0.136 inches). In another example, aperture 385 may extend a depth between about ⅛ of depth 374 and depth 374 (e.g., about depth 374). In another example, aperture 385 may extend a depth of between about 0.023 inches and about 0.5 inches (e.g., about 0.1875 inches). Aperture 385 may have a circular cross-section (e.g., in a height-width cross-section).

Rail nut spacer 370 may have at least one insert 390 positioned at least partially within aperture 385 to enable securement with at least one fastener 353. Insert 390 may have an interior surface 391 forming an aperture 392 capable of receiving fastener 353. For example, aperture 392 may substantially align with a fastener extending through a bezel (e.g., fastener 153 of FIG. 1). In another example, interior surface 391 may include a threaded portion 394 (e.g., having a pitch and diameter), and may be capable of receiving a threaded portion 354 of fastener 353 (e.g., a screw of corresponding pitch and diameter). Further, aperture 392 may substantially align with aperture 385 (e.g., both may be centered about axis 369).

Insert 390 may have an exterior surface 393 to enable securement of insert 390 within body portion 371. Exterior surface 393 may be uniformly and/or non-uniformly shaped. For example, exterior surface 393 may have surface characteristics 395 including any one or more of a peak, trough, ridge, valley, or any combination thereof, such that movement with respect to body portion 371 may be prevented. For example, surface characteristics 395 may prevent insert 390 from rotational and/or translational movement with respect to body 371 of rail nut spacer 370. Surface characteristics 395 may exist at one or more discrete locations, or may extend across exterior surface 393 (e.g., around an outer circumference and/or perimeter of insert 390).

Fastener 353 may be secured to rail nut spacer 370 after rail nut spacer 370 has been inserted into a slot of a housing (e.g., rail slot 811 of housing 801 as in FIG. 8) in order to secure a bezel to the housing (e.g., bezel 150 of FIG. 1). Thus, as fastener 353 is tightened within aperture 392 of insert 390 (e.g., as exemplified in FIG. 3B), fastener 353 may pull with an increasing force 356. Rail nut spacer 370 may resist force 356 with an equal and opposing force 396 (e.g., due to being held within the slot). Accordingly force 356 and/or opposing force 396 may be transferred through insert 390 such that the interconnection between insert 390 and rail nut spacer 370 must be capable of resisting these forces.

Insert 390 may be capable of resisting force 356 and/or opposing force 396 up to a predetermined level of force. For example, as fastener 353 is tightened, threaded portion 354 may be retained within threaded portion 394 of insert 390 at least up to the predetermined level of force. In another example, as fastener 353 is tightened, surface characteristics 395 may enable insert 390 to be retained within body 371 of rail nut spacer 370 at least up to the predetermined level of force. Beyond the predetermined level of force failure of threaded portions 354, 394 and/or failure of surface characteristics 395 may occur (e.g., via stripping). The predetermined level of force may be sufficient to enable a bezel (e.g., bezels 150 and 155 of FIG. 1) to adequately apply pressure to a media (e.g., media 147 of FIG. 1), such that media is sealed across a housing (e.g., housing 101 of FIG. 1).

Figure 4:
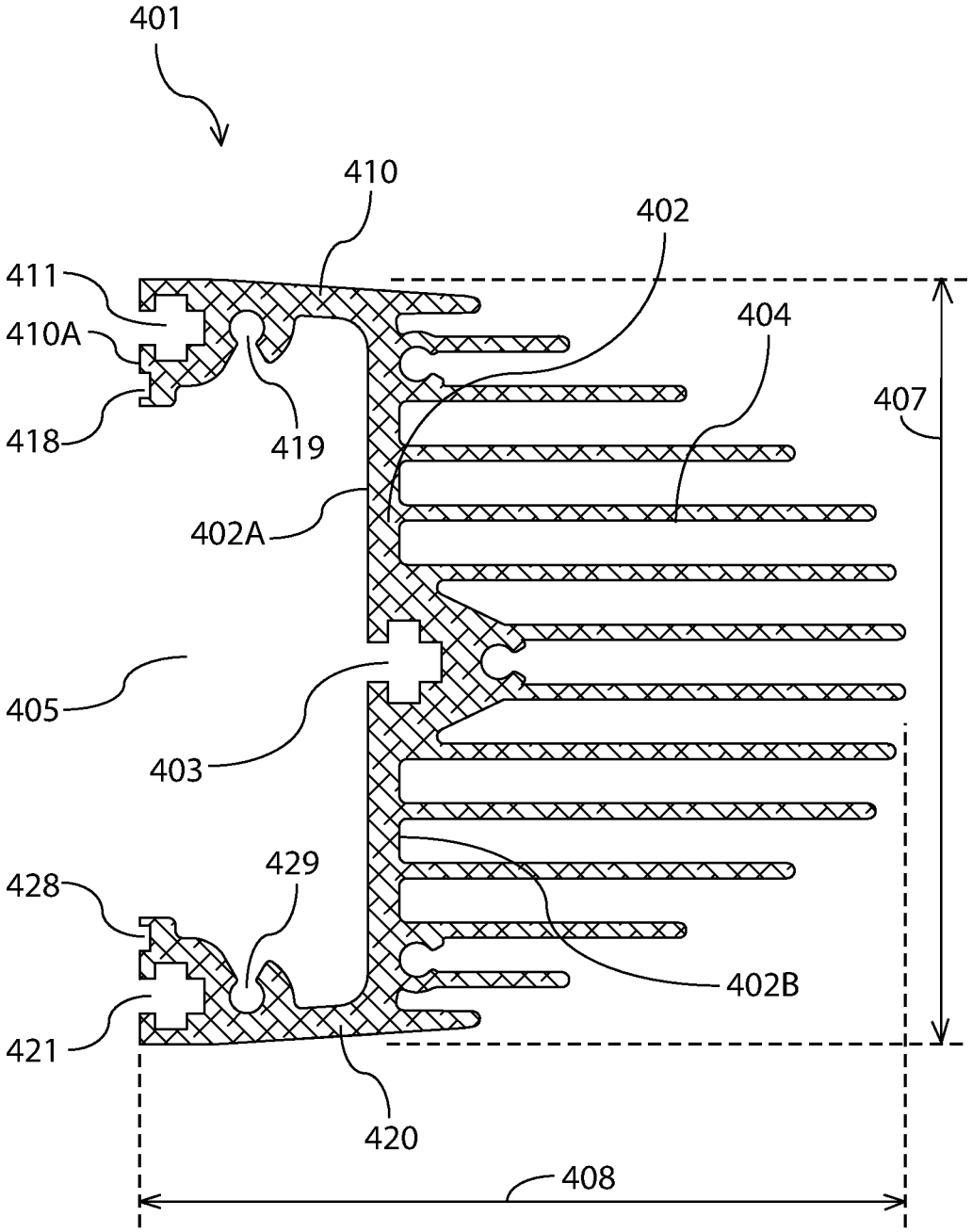
FIG. 4 illustrates a cross-sectional view of the housing of FIG. 1.

FIG. 4 illustrates a cross-sectional cut view through a housing 401 of a lighting fixture (e.g., lighting fixture 100 of FIG. 1). The cross-sectional cut may extend through a height-depth plane of housing 401 (e.g., height 407 and depth 408). FIG. 4 illustrates the substantial shape of housing 401 at a discrete location along a width thereof (e.g., width 109 of FIG. 1). The shape, as exemplified, may be substantially uniform or non-uniform along a width of the housing (e.g., corresponding to width 109 of FIG. 1). Housing 401 may include a body portion 402 forming a core of housing 401 with one or more features extending therefrom and/or therein. For example, body portion 402 may include a slot 403 extending into a forward face 402A of body portion 402, which may include a particular cross-sectional shape to enable attachment of one or more components (e.g., a PCBA including control circuitry and/or LEDs) to body portion 402. In another example, fins 404 may extend uni-directionally and/or multi-directionally from a rearward face 402B of body portion 402 to enable cooling of housing 401 in response to heat generated by the one or more components (e.g., heat generated by the a PCBA and/or one or more LEDs may be transferred by conduction through body portion 402 into fins 404, and may be conveyed away from fins 404 by convection).

Housing 401 may include one or more perimeter walls (e.g., perimeter walls 410, 420) extending from forward face 402A of body portion 402. For example, top perimeter wall 410 and bottom perimeter wall 420 may extend from forward face 402A at opposing ends of body portion 402 (e.g., at opposing ends of height 407 of housing 401). Body portion 402, top perimeter wall 410 and bottom perimeter wall 420 may form an opening 405, which may be capable of housing the one or more components. For example, opening 405 may extend from forward face 402A and may extend between top and bottom perimeter walls 410, 420.

Each perimeter wall may include one or more slots (e.g., slot 411) extending therethrough in a width-wise direction (e.g., spanning width 109 of FIG. 1). For example, a rail slot 411 may extend into a forward face 410A of top perimeter wall 410 to enable reception of one or more rail nut spacers (e.g., rail nut spacer 370 of FIG. 3). In another example, a forward slot 418 may extend into forward face 410A to enable reception of one or more gaskets (e.g., gasket 649 of FIG. 6). In another example, an inner slot 419 may extend into top perimeter wall 410 so as to open toward opening 405 to enable attachment of one or more end caps (e.g., end caps 130, 140 of FIG. 1). In another example, bottom perimeter wall 420 may have one or more slots corresponding to the slots of top perimeter wall 410 (e.g., rail slot 421, forward slot 428, and/or inner slot 429). The slots of bottom perimeter wall 420 may be dimensioned similarly to and/or differently from the slots of top perimeter wall 410.

Rail slots 411, 421, forward slots 418, 428, inner slots 419, 429, and slot 403 of body portion 402 may include similar or different cross-sectional shapes. For example, rail slots 411, 421, and slot 403 may have a first cross-sectional shape. In another example, forward slots 418, 428 may have a second cross-sectional shape. In another example, inner slots 419, 429 may have a third cross-sectional shape. In another example, the first, second, and third cross-sectional shapes may be similar or different.

Figure 5:
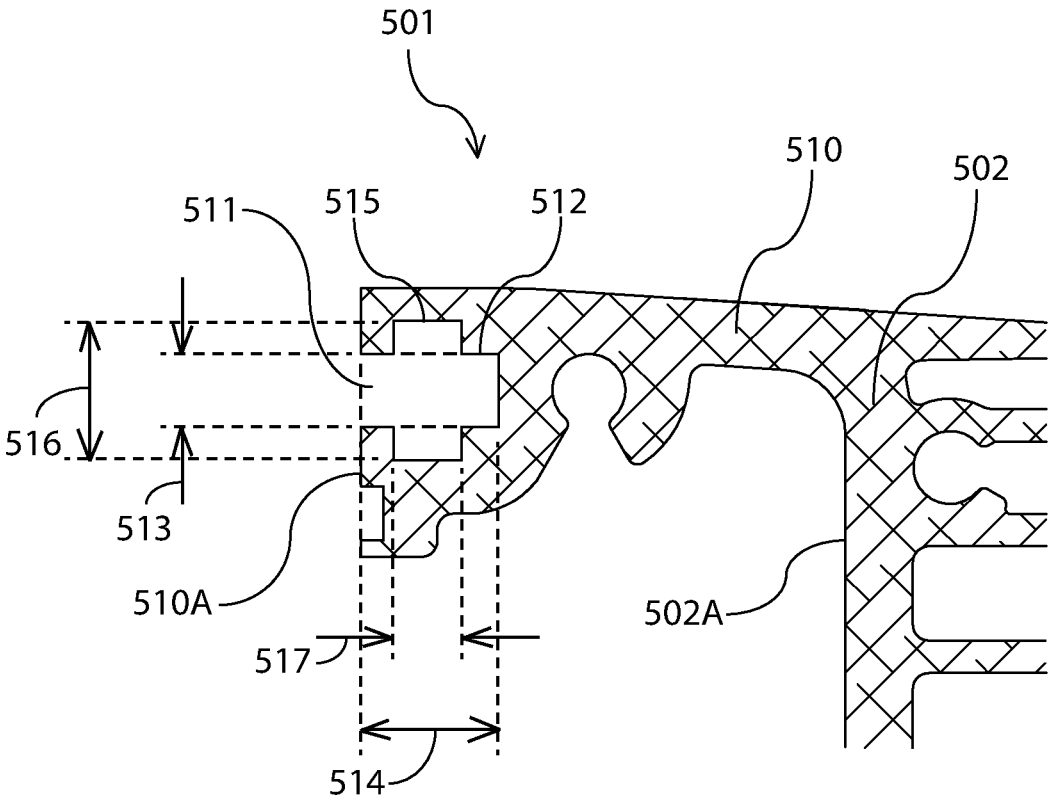
FIG. 5 illustrates a cross-sectional view of a segment of the housing of FIG. 1.

FIG. 5 illustrates a cross-sectional cut view through a segment of a housing 501 of a lighting fixture (e.g., lighting fixture 100 of FIG. 1). The cross-sectional cut may extend through a height-depth plane of housing 401 (e.g., height 407 and depth 408 of FIG. 4). FIG. 5 illustrates a segment showing a top perimeter wall 510 extending from a forward face 502A of a body portion 502 of housing 501. Top perimeter wall 510 may have one or more slots (e.g., slot 511) extending therethrough in a width-wise direction (e.g., along width 109 of FIG. 1). For example, a rail slot 511 may extend into a forward face 510A of top perimeter wall 510.

Rail slot 511 may have a particular cross-sectional shape to discourage rotational and/or translational movement of a rail nut spacer when assembled therein (e.g., rail nut spacer 670 of FIG. 6). For example, rail slot 511 may substantially be a negative image of the rail nut spacer (e.g., rail nut spacer 670 of FIG. 6). In another example, rail slot 511 may substantially appear as any one or more of a "+" shape (as exemplified in FIG. 5), a "C" shape, a "T" shape, a "V" shape, an "L" shape, a "U" shape, and/or any other parallelogram shape (e.g., a triangular shape), such that rotational and/or translational movement of rail nut spacer 370 within the slot is discouraged.

In another example, rail slot 511 may include one or more straight portions 512 extending a slot height 513 and spanning a slot depth 514, and may further include one or more internal portions 515 extending an internal height 516 and spanning an internal depth 517. In one example, slot height 513 may be less than internal height 516. In another example, internal depth 517 may be less than slot depth 514. In another example, internal portion 515 may extend one or both of above and below straight portion 512, such that internal height 516 may extend one or both of above and below slot height 513 (e.g., extending above and below as exemplified in FIG. 5). In another example, straight portion 512 may extend one or both of leftward and rightward of internal portion 515, such that slot depth 514 may extend one or both of leftward and rightward of internal depth 517 (e.g., extending rightward and leftward as exemplified in FIG. 5).

While slot height 513 appears to be substantially similar in dimension to internal depth 517, a person of ordinary skill in the art will appreciate that the dimension of slot height 513 may be less than, similar to, or greater than the dimension of internal depth 517. Furthermore, while internal height 516 appears to be substantially similar in dimension to slot depth 514, a person of ordinary skill in the art will appreciate that the dimension of internal height 516 may be less than, similar to, or greater than the dimension of slot depth 514.

While rail slot 511 has been described as it corresponds to top perimeter wall 510, a person of ordinary skill in the art will appreciate that a corresponding slot in a bottom perimeter wall (e.g., rail slot 421 in bottom perimeter wall 420 of FIG. 4) may be dimensioned identically and/or differently to rail slot 511. Further, a person of ordinary skill in the art will appreciate that rail slot 511 may be dimensioned identically or differently to a slot situated in forward face 502A of body portion 502 (e.g., slot 403 in body portion 402 of FIG. 4).

FIG. 6 illustrates a cross-sectional cut view through a lighting fixture 600. The cross-sectional cut may extend through a height-depth plane of lighting fixture 600 at a discrete location along a width thereof (e.g., height 107, depth 108, and width 109 of FIG. 1). Lighting fixture 600 may include a housing 601 capable of attachment with the various components of the lighting fixture 600. For example, an end cap 640 may be secured to one end of housing 601 by fasteners 606 extending into inner slots 619, 629 of housing 601 (e.g., exemplified as behind housing 601).

Housing 601 may include a top perimeter wall 610 and a bottom perimeter wall 620 extending from a forward face 602A of a base portion 602, such that an opening 605 extends from forward face 602A between the top and bottom perimeter walls 610, 620. Electronic components (e.g., a PCBA and/or LEDs) may be received within opening 605 and may be secured to forward face 602A (e.g., via slot 603 of base portion 602). Heat generated by the electronic components during operation may be dissipated through base portion 602 to one or more fins 604. Top perimeter wall 610 and bottom perimeter wall 620 may have one or more slots (e.g., slots 611, 618, 619, 621, 628, 629) extending therethrough in a width-wise direction (e.g., along width 109 of FIG. 1).

One or more rail nut spacers 670 and/or one or more rail nut spacer segments (e.g., segments 295A-295C of FIG. 2) may be inserted into rail slots 611, 621 to enable attachment of one or more bezels (e.g., bezels 650, 655). For example, a single rail nut spacer 670 may span a width (e.g., width 275 of FIG. 2) substantially corresponding to a width of lighting fixture 600 (e.g., width 109 of FIG. 1). In another example, the cross-sectional shape of rail nut spacers 670 may substantially match the cross-sectional shape of rail slots 611, 621 to prevent rotational and/or translational movement when rail nut spacers 670 are positioned within rail slots 611, 621. In another example, rail nut spacers 670 may be oriented such that one or more apertures 685 of each rail nut spacer 670 are viewable from the same direction that forward face 602A of base portion 602 is viewable (e.g., viewing lighting fixture 600 from a front side, or from the left side of FIG. 6). In another example, a central axis (e.g., central axis 369 of FIG. 3) of each aperture 685 may extend forwardly of the lighting fixture 600.

Opening 605 may be enclosed and/or sealed by a media 647 to protect the electronic components from moisture and/or other contaminants. For example, media 647 may extend from top perimeter wall 610 to bottom perimeter wall 620. In another example, media 647 may extend from a forward slot 618 in top perimeter wall 610 to a forward slot 628 in bottom perimeter wall 620. In another example, media 647 may be sealed to top and bottom perimeter walls 610, 620 by at least one gasket 649 interposed therebetween (e.g., gasket 649 may extend within forward slots 618, 628).

A top bezel 650 and a bottom bezel 655 may be placed in a covering relationship over rail slots 611, 621, respectively, to enable securement of top and bottom bezels 650, 655 to rail nut spacers 670 extending through rail slots 611, 621. For example, top and bottom bezels 650, 655 may have one or more apertures 651, 656, respectively, extending therethrough. In another example, apertures 651, 656 may align with apertures 685 of each rail nut spacer 670. In another example, one or more fasteners 653, 658 may extend through apertures 651, 656, respectively, may extend through slots 611, 621, respectively, and may extend into apertures 685 of rail nut spacers 670 (e.g., causing top and bottom bezels 650, 655 to be secured to top and bottom perimeter walls 610, 620, respectively).

Top and bottom bezels 650, 655 may extend at least partially over media 647 to enable securement of media 647 to top and bottom perimeter walls 610, 620, respectively. For example, top and bottom bezels 650, 655 may apply a force against media 647 to cause gasket 649 to be compressed between media 647 and top and bottom perimeter walls 610, 620, respectively. In another example, gasket 649 may extend around a perimeter of media 647, such that top and bottom bezels 610, 620 may apply a force causing deformation of gasket 649 between any one or more of media 647, top and bottom perimeter walls 610, 620, and/or top and bottom bezels 650, 655, respectively.

In another example, tightening of fasteners 653, 658, may cause top and bottom bezels 650, 655 to be secured to top and bottom perimeter walls 610, 620, respectively. In another example, tightening of fasteners 653, 685 may cause top and bottom bezels 650, 655 to compress media 647 and a gasket 649 against top and bottom perimeter walls 610, 620, respectively. In another example, tightening of fasteners 653, 685 may cause media 647 to substantially enclose and/or seal opening 605, and enable the electronic components to be protected from an environment exterior to opening 605.

The present invention also contemplates the use of one or more rail nut spacers 670 and/or segments (e.g., segments 295A-295C of FIG. 2) in slot 603 of body portion 602. For example, one or more rail nut spacers 670 and/or segments may be assembled into slot 603 in a width-wise direction (e.g., along width 109 of FIG. 1). The electronic components (e.g., one or more PCBAs) may be secured to body portion 602 in much the same way bezel 650 is secured to top perimeter wall 610 (e.g., via fasteners extending therethrough into rail nut spacers 670 and/or rail nut spacer segments).

Figure 7:
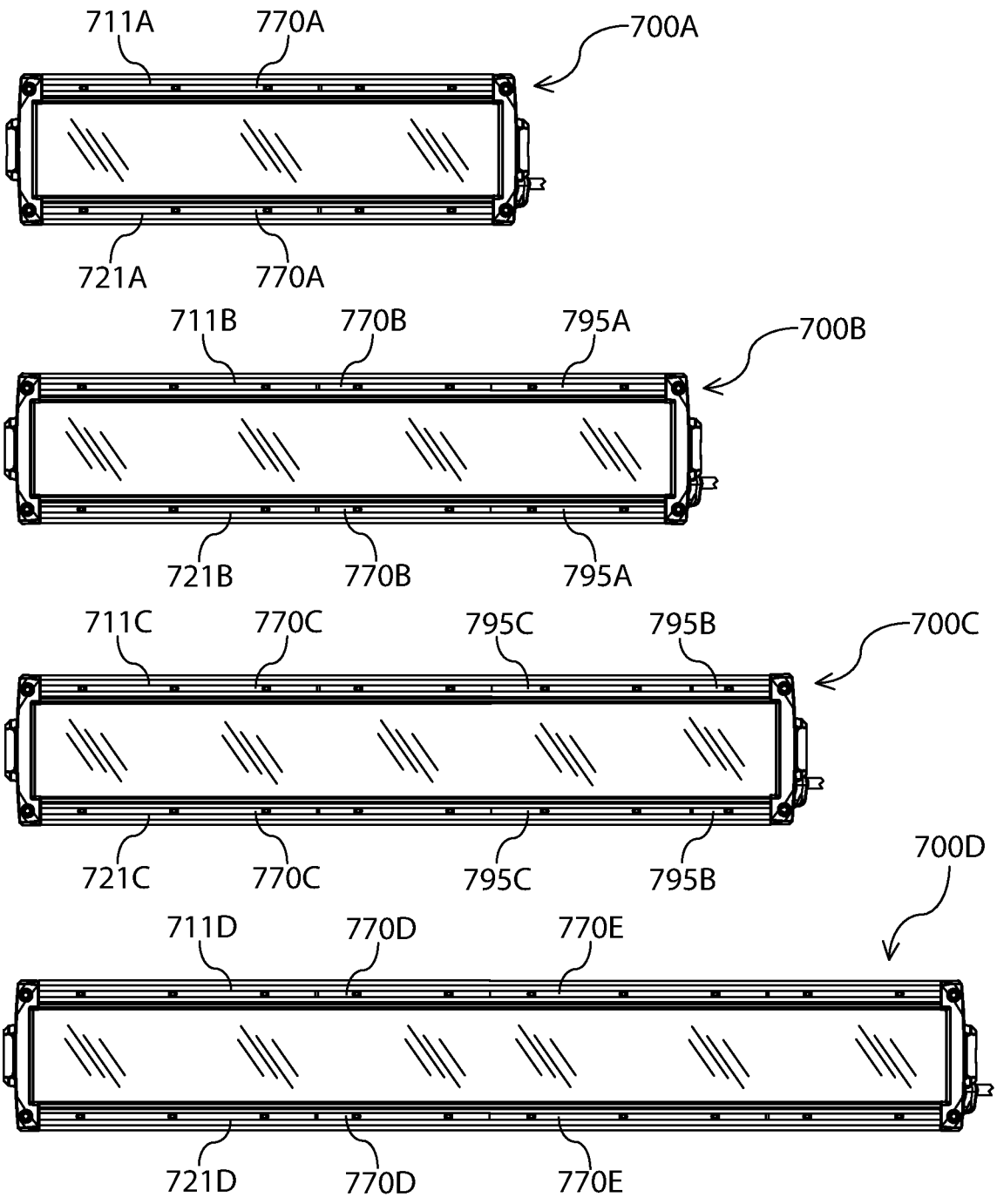
FIG. 7 illustrates a front view of four lighting fixtures with bezels removed.

FIG. 7 illustrates a forward view of four lighting fixtures (e.g., lighting fixtures 700A, 700B, 700C, 700D). Each lighting fixture may have a housing (e.g., housing 101 of FIG. 1) and a media (e.g., media 147 of FIG. 1) positioned across a forward face of each housing, respectively. For illustrative purposes which will become apparent below, bezels extending across respective widths (e.g., width 109 of FIG. 1) of each lighting fixture have been removed.

Lighting fixtures 700A-700D may each have one or more rail nut spacers (e.g., rail nut spacers 770A-770E), and/or one or more segments (e.g., segments 795A, 795C) assembled in rail slots (e.g., rail slots 711A-711D, 721A-721D). For example, lighting fixture 700A may have one rail nut spacer 770A assembled within rail slot 711A, and may have one rail nut spacer 770A assembled within rail slot 721A, each in a width-wise direction (e.g., along width 109 of FIG. 1). Thus, in this example, each rail nut spacer 770A may substantially span the entire width of lighting fixture 700A.

In another example, lighting fixture 700B may have a set including one rail nut spacer 770B and one rail nut spacer segment 795A assembled within slot 711B, and/or may have a set including one rail nut spacer 770B and one rail nut spacer segment 795A assembled within slot 721B, each set extending in a width-wise direction (e.g., along a width of lighting fixture 700B). For example, each segment 795A may be created by singulating a full width rail nut spacer (e.g., rail nut spacer 270 of FIG. 2) into a first segment (e.g., segment 795A) and a second segment (e.g., including segments 795B and 795C). The unused segment (e.g., the second segment) may be used wholly in another lighting fixture (e.g., lighting fixture 700C), may be further singulated into segments 795B, 795C, one or both of which may be used wholly or separately in another lighting fixture (e.g., segment 795C may be used in a lighting fixture or corresponding width to lighting fixture 700B), and/or may be discarded (e.g., segment 795B may be discarded). Thus, in this example, the rail nut spacer 770B and segment 795A may collectively span the entire width of lighting fixture 700B.

In another example, lighting fixture 700C may have a set including one rail nut spacer 770C and one rail nut spacer segment (e.g., including segments 795B, 795C, collectively, and unsingulated) assembled within slot 711C, and/or may have a set including one rail nut spacer 770C and one rail nut spacer segment (e.g., including segments 795B, 795C, collectively, and unsingulated) assembled within slot 721C, each set extending in a width-wise direction (e.g., along a width of lighting fixture 700C). For example, each rail nut spacer segment may be created by singulating a full width rail nut spacer (e.g., rail nut spacer 270 of FIG. 2) into a first segment (e.g., segment 795A) and a second segment (e.g., including segments 795B and 795C). The unused segment (e.g., the first segment) may be used wholly in another lighting fixture (e.g., lighting fixture 700B), and/or may be discarded (e.g., segment 795A may be discarded). Thus, in this example, the rail nut spacer 770C and rail nut spacer segments 795B, 795C may collectively span the entire width of lighting fixture 700C.

In another example, lighting fixture 700D may have a set including two rail nut spacers 770D, 770E assembled within slot 711D, and/or may have a set including two rail nut spacers 770D, 770E assembled within slot 721D, each set extending in a width-wise direction (e.g., along a width of lighting fixture 700D). Thus, in this example, the two rail nut spacers 770D, 770E may collectively span the entire width of lighting fixture 700D.

Lighting fixtures 700A-700D illustrate the use of one or more rail nut spacers (e.g., rail nut spacers 770A-770E), and/or one or more segments (e.g., segments 795B-795D), however, a person of ordinary skill in the art will appreciate that lighting fixtures may employ greater numbers of rail nut spacers and rail nut spacer segments for each lighting fixture of incrementally greater width. Thus, the instant invention may provide for bezel attachment for a lighting fixture of any width. For example, one or more rail nut spacers 770 may be used in connection with lighting fixtures having an incremental increase in width of about 10 inches (e.g., 10 inches, 20 inches, 30 inches, 40 inches, 50 inches, and greater).

In another example, one rail nut spacer 770 may be singulated at a first groove to form a first segment (e.g., segment 795A) and a second segment (e.g., segments 795B, 795C). The first and second segments may be different in length. For example, a shorter segment may be about 4 inches, and a longer segment may be about 6 inches (e.g., where the non-singulated rail nut spacer 770 was originally about 10 inches). Thus, one or more of the first segments may be used in connection with lighting fixtures having an incremental increase in width of about 4 inches (e.g., 4 inches, 8 inches, 12 inches, 16 inches, 20 inches, and greater). Further, one or more of the second segments may be used in connection with lighting fixtures having an incremental increase in width of about 6 inches (e.g., 6 inches, 12 inches, 18 inches, 24 inches, 30 inches, and greater).

In another example, one or more rail nut spacers 770 (e.g., about 10 inches) and one of the first segments (e.g., about 4 inches) may be used in connection with lighting fixtures having an incremental increase in width of about 10 inches (e.g., 14 inches, 24 inches, 34 inches, 44, inches, 54 inches, and greater). Further, one or more rail nut spacers 770 and one or more of the first segments may be used in connection with lighting fixtures having a non-uniform incremental increase in width (e.g., 14 inches, 18 inches, 24 inches, 28 inches, 34 inches, and greater).

In another example, one or more rail nut spacers 770 (e.g., of about 10 inches in length) and one of the second segments (e.g., of about 6 inches in length) may be used in connection with lighting fixtures having an incremental increase in width of about 10 inches (e.g., 16 inches, 26 inches, 36 inches, 46, inches, 56 inches, and greater). Further, one or more rail nut spacers 770 and one or more of the second segments may be used in connection with lighting fixtures having a non-uniform incremental increase in width (e.g., 16 inches, 22 inches, 26 inches, 32 inches, 36 inches, and greater).

While rail nut spacer 770 has been discussed as being about 10 inches, and the rail nut spacer segments have been discussed as being about 4 and about 6 inches, a person of ordinary skill in the art will appreciate that smaller or greater values may be used to increase variability of the present invention. For example, rail nut spacer 770 may be between about 2 inches and about 54 inches, and rail nut spacer segments may be between about 0.5 inches and 52 inches).

Figure 8A:
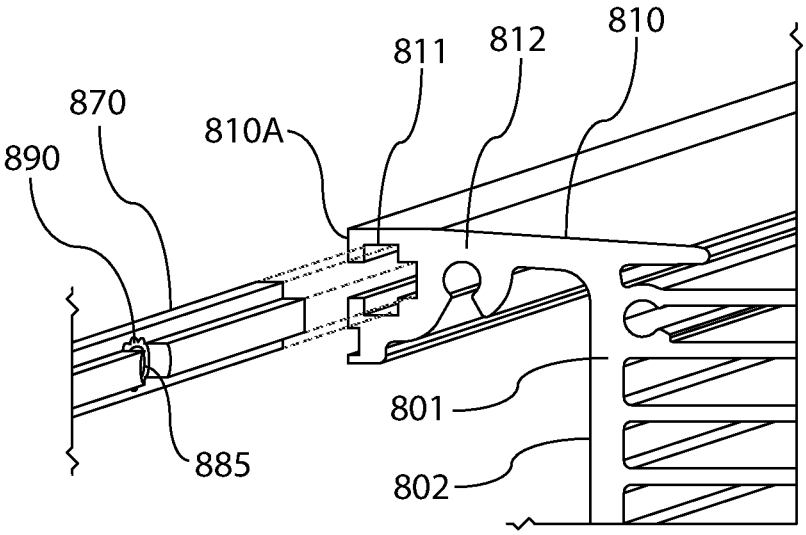
FIG. 8A illustrates an isometric view of a rail nut spacer insertable into a slot of a housing.
Figure 8B:
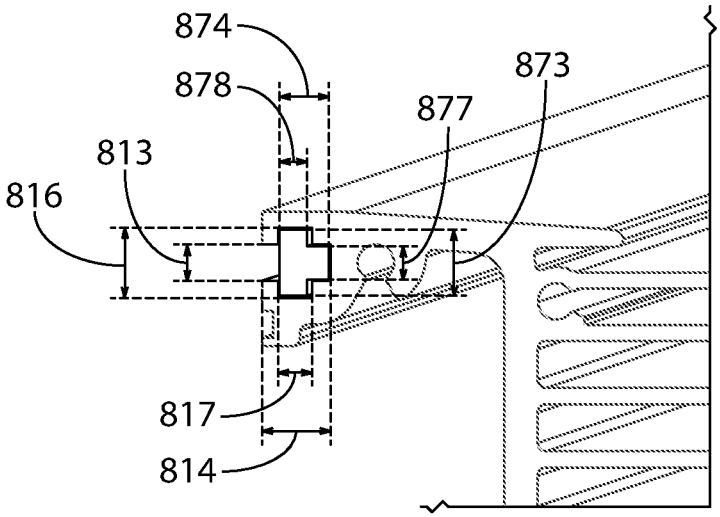
FIG. 8B illustrates an isometric view of the rail nut spacer of FIG. 8A, inserted into the slot of the housing.

FIGS. 8A and 8B illustrate an isometric view of a segment of a housing 801 being assembled with a rail nut spacer 870 (e.g., as used in the lighting fixture 600 of FIG. 6). While not illustrated here, a person of ordinary skill in the art will appreciate that the principles disclosed in with regard to FIGS. 8A and 8B apply equally to additional rail nut spacers, and one or more rail nut spacer segments. Housing 801 may include at least one perimeter wall 810 extending from a forward face 802. Perimeter wall 810 may include at least one rail slot 811 extending through perimeter wall 810 along a width thereof (e.g., along width 109 of FIG. 1). Further, rail slot 811 may be open to a forward face 810A of perimeter wall 810 and/or at each end thereof (e.g., at a first side 812). Forward face 810A of perimeter wall 810 may face in the same direction as forward face 802 of housing 801 (e.g., forwardly of housing 801).

A rail nut spacer 870 may be configured to be insertable into rail slot 811 in an optimal geometric configuration to facilitate attachment of a bezel (e.g., bezel 650 of FIG. 6). Further, rail nut spacer 870 may include at least one insert 890 extending through at least one aperture 885. For example, insert 890 and/or aperture 885 may be visible through rail slot 811 from forward face 810A when rail nut spacer 870 is inserted into rail slot 811 (e.g., as exemplified in FIG. 7). In another example, at least one fastener (e.g., fastener 653 of FIG. 6) may extend through the bezel, may extend through rail slot 811, and may be secured to insert 890. Thus, in the optimal geometric configuration, insert 890 may be configured within rail slot 811 to receive the fastener in order to secure the bezel.

Securement of the fastener within insert 890 may simultaneously cause insert 890 and a bezel (e.g., bezel 650 of FIG. 6) to be pulled toward forward face 810A. Insert 890 may include surface characteristics (e.g., surface characteristics of exterior surface 393 of FIG. 3) to retain insert 890 within rail nut spacer 870, such that rail nut spacer 870 may be pulled toward forward face 810A. The surface characteristics of insert 890 may enable up to a predetermined level of force to be applied between rail nut spacer 870 and rail slot 811. The predetermined level of force may be sufficient to enable stable securement of the bezel to housing 801 without causing insert 890 to be disengaged from rail nut spacer 870 (e.g., via stripping of the surface characteristics), and/or without causing the fastener to be disengaged from insert 890 (e.g., via stripping of the fastener and/or insert 890).

The optimal geometric configuration may further be facilitated by a cross-sectional shape of rail nut spacer 870 and/or a cross-sectional shape of rail slot 811. For example, a cross-sectional shape of rail nut spacer 870 may be configured to be insertable within a corresponding cross-sectional shape of rail slot 811. In another example, the cross-sectional shape of rail slot 811 may enable insertion of rail nut spacer 870 only in the optimal geometric configuration. In another example, the cross-sectional shape of rail slot 811 may enable insertion of rail nut spacer 870 in two or more optimal geometric configurations (e.g., wherein insert 890 may be accessible for attachment with one or more fasteners).

In another example, rail slot 811 may include at least one first portion (e.g., straight portion 512 of FIG. 5) extending into perimeter wall 810 from forward face 810A by a slot height 813 and a slot depth 814. Rail slot 811 may further include at least one second portion (e.g. internal portion 515 of FIG. 5) extending from the first portion (e.g., entirely within perimeter wall 810), the second portion extending an internal height 816 and an internal depth 817. As exemplified in FIG. 8B, the second portion may extend in two opposing directions from the first portion, where the internal height 816 and internal depth 817 may define the entire second portion.

Further, rail nut spacer 870 may include at least one central portion (e.g., central portion 372 of FIG. 3) extending a central height 877 and a depth 874, and at least one extending portion (e.g., extending portion 376 of FIG. 3) extending a height 873 and an intermediate depth 878. As exemplified in FIG. 8B, the extending portion may extend in two opposing directions from the central portion, where the height 873 and intermediate depth 878 may define the entire extending portion.

Rail nut spacer 870 may be appropriately sized to be insertable within rail slot 811. For example, slot height 813 may be approximately equal to and/or larger than central height 877. In another example, slot depth 814 may be approximately equal to and/or larger than depth 874. In another example, internal height 816 may be approximately equal to and/or larger than height 873. In another example, internal depth 817 may be approximately equal to and/or larger than intermediate depth 878. Thus, rail nut spacer 870 may be insertable within rail slot 811 in at least an interference fit and/or a loose fit.

Further, securement of the fasteners may cause an increase in frictional engagement between one or more surfaces of rail nut spacer 870 and one or more surfaces of rail slot 811, such that rail nut spacer 870 may be secured in place thereby. For example, rail slot 811 may prevent rail nut spacer 870 from being moved in a direction that is perpendicular to the direction in which rail nut spacer 870 is inserted into the slot (E.g., prevented from movement in a forward direction, or from movement through rail slot 811 at forward face 810A). In another example, securement of the fasteners may prevent rail nut spacer 870 from being moved in any direction (e.g., due to friction).

The optimal geometric configuration may be facilitated by appropriate sizing of one or more of slot height 813, slot depth 814, internal height 816, and internal depth 817 of rail slot 811 and/or by appropriate sizing of one or more of central height 877, depth 874, height 873, and intermediate depth 878 of rail nut spacer 870. For example, slot height 813 may be sized to receive central height 877, but may be improperly sized to receive intermediate depth 878. In another example, slot depth 814 may be sized to receive depth 874, but may be improperly sized to receive height 873. In another example, internal height 816 may be sized to receive height 873, by may be improperly sized to receive depth 874. In another example, internal depth 817 may be sized to receive intermediate depth 878, but may be improperly sized to receive central height 877.

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. A rail nut spacer coupled within a slot of a lighting fixture, the rail nut spacer comprising:

a body having a width; and one or more threaded inserts coupled with substantially equal spacing within the width of the body, wherein the one or more threaded inserts are restricted from movement relative to the body.

2. The rail nut spacer of claim 1, wherein each of the one or more threaded inserts includes an aperture having a threaded portion, each threaded portion configured to interconnect with a threaded portion of a corresponding fastener extending through the slot.

3. The rail nut spacer of claim 2, wherein each fastener is configured to couple one or more bezels to the lighting fixture, wherein the one or more bezels are configured to secure a media over a compartment of the lighting fixture, and wherein the media is sealed against the lighting fixture to prevent passage of particulates or other contaminants from entering the compartment.

4. The rail nut spacer of claim 1, wherein the body is configured with a cross-sectional shape extending along the width, the cross-sectional shape substantially resembling any one of a "+" shape, a "C" shape, a "T" shape, a "V" shape, an "L" shape, a "U" shape, or any other parallelogram shape which restricts movement of the rail nut spacer within the slot.

5. A rail nut spacer coupled within a slot of a housing, the rail nut spacer comprising:

a body having a width and a parallelogram cross-section which restricts movement of the rail nut spacer within the slot; and one or more threaded inserts coupled within the width of the body, wherein the one or more threaded inserts are restricted from movement relative to the body.

6. The rail nut spacer of claim 5, wherein a first threaded insert of the one or more threaded inserts is spaced a first distance from a second threaded insert of the one or more threaded inserts, and wherein the second threaded insert is spaced a second distance from a third threaded insert of the one or more threaded inserts.

7. The rail nut spacer of claim 6, wherein the third threaded insert is spaced a third distance from a fourth threaded insert of the one or more inserts, wherein the fourth threaded insert is spaced a fourth distance from a fifth threaded insert of the one or more inserts, and wherein the first, second, third and fourth distances are the same.

8. The rail nut spacer of claim 6, wherein the first threaded insert is spaced a third distance from an end face of the body at one side of the width, and wherein the third distance is less than the first distance.

9. The rail nut spacer of claim 6, wherein a first groove of one or more grooves is spaced a third distance from the first threaded insert to enable singulation of the body of the rail nut spacer into two or more rail nut spacer segments, each segment including one or more threaded inserts, and wherein the third distance is less than the first distance.

10. The rail nut spacer of claim 9, wherein a second groove of the one or more grooves is spaced a fourth distance from the third threaded insert, the first and second grooves enabling singulation of the body of the rail nut spacer into three or more rail nut spacer segments.

11. A bezel attachment system, comprising:

a housing having a compartment extending a width of the housing;

a slot extending along the width of the housing;

a first rail nut spacer configured in the slot;

a media configured in a covering relationship with the compartment;

a bezel configured in a covering relationship with the slot; and a plurality of fasteners coupled to the first rail nut spacer through the slot, and the plurality of fasteners coupled to the bezel, such that the bezel is coupled to the housing.

12. The bezel attachment system of claim 11, wherein the first rail nut spacer includes a body having a width, the first rail nut spacer including one or more threaded inserts spaced along the width.

13. The bezel attachment system of claim 12, wherein the width of the first rail nut spacer and the width of the housing are equal.

14. The bezel attachment system of claim 12, wherein the bezel attachment system further includes one or more rail nut spacer segments configured in the slot, the one or more rail nut spacer segments formed by singulating one or more additional rail nut spacers at one or more grooves, the one or more rail nut spacer segments each including a body having a corresponding singulated width, each of the one or more rail nut spacer segments including one or more threaded inserts spaced along the corresponding singulated width, and the plurality of fasteners coupled to the one or more rail nut spacer segments through the slot.

15. The bezel attachment system of claim 14, wherein the width of the housing and the combined width of the first rail nut spacer and the one or more rail nut spacer segments are equal.

16. The bezel attachment system of claim 12, wherein the bezel attachment system further includes one or more additional rail nut spacers configured in the slot, the one or more additional rail nut spacers each including a body having a corresponding width, each of the one or more additional rail nut spacers including one or more threaded inserts spaced along the corresponding width, and the plurality of fasteners coupled to the one or more additional rail nut spacers through the slot.

17. The bezel attachment system of claim 16, wherein the corresponding widths of each of the first rail nut spacer and the one or more additional rail nut spacers are equal, and wherein the width of the housing and the combined width of the first rail nut spacer and the one or more additional rail nut spacers are equal.

18. The bezel attachment system of claim 16, wherein the bezel attachment system further includes one or more rail nut spacer segments configured in the slot, the one or more rail nut spacer segments formed by singulating one or more additional rail nut spacers at one or more grooves, the one or more rail nut spacer segments each including a body having a corresponding singulated width, each of the one or more rail nut spacer segments including one or more threaded inserts spaced along the corresponding singulated width, and the plurality of fasteners coupled to the one or more rail nut spacer segments through the slot.

19. The bezel attachment system of claim 18, wherein the width of the housing and the combined width of the first rail nut spacer, the one or more additional rail nut spacers, and the one or more rail nut spacer segments are equal.

20. The bezel attachment system of claim 11, wherein the bezel is configured to secure the media over the compartment of the housing, and wherein the media is sealed against the housing to prevent passage of particulates or other contaminants from entering the compartment.

* * * * *